US005609498A

United States Patent [19]

Muzslay

[11] Patent Number: 5,609,498

[45] Date of Patent: Mar. 11, 1997

[54] SECURE CONNECTOR SYSTEM

[75] Inventor: Steven Z. Muzslay, Huntington Beach, Calif.

[73] Assignee: ITT Corporation, New York, N.Y.

[21] Appl. No.: 534,921

[22] Filed: Sep. 19, 1995

[51] Int. Cl.[6] ..... H01R 13/627

[52] U.S. Cl. ..... 439/352; 439/354

[58] Field of Search ..... 439/350–355, 439/357, 358, 304

[56] References Cited

U.S. PATENT DOCUMENTS

| | | | |
|---|---|---|---|
| 3,382,558 | 5/1968 | Lutz | 439/744 |
| 3,471,825 | 10/1969 | Huber | 439/357 |
| 3,569,903 | 3/1971 | Brishka | 439/352 |
| 3,671,922 | 6/1972 | Zerlin | 439/352 |
| 3,951,514 | 4/1976 | Medina | 385/55 |
| 4,163,594 | 8/1979 | Aujla | 439/304 |
| 4,170,939 | 10/1979 | Hoheisel | 200/51.1 |
| 4,211,461 | 7/1980 | Wescott | 439/352 |
| 4,470,651 | 9/1984 | Schwab | 439/188 |
| 4,526,431 | 7/1985 | Kasukawa | 439/352 |
| 4,628,818 | 12/1986 | Nilsson | 102/202.2 |
| 4,971,568 | 11/1990 | Cronin | 439/188 |
| 4,988,307 | 1/1991 | Muzslay | 439/188 |
| 5,064,973 | 11/1991 | Zinn et al. | 439/188 |
| 5,275,575 | 1/1994 | Cahaly et al. | 439/188 |
| 5,314,345 | 5/1994 | Cahaly et al. | 439/188 |
| 5,334,025 | 8/1994 | Fohl | 439/188 |
| 5,401,180 | 3/1995 | Muzslay | 439/188 |
| 5,435,754 | 7/1995 | Hotea | 439/620 |

*Primary Examiner*—Hien Vu
*Attorney, Agent, or Firm*—Thomas L. Peterson

[57] ABSTRACT

A connector system includes a plug connector that latches to a receptacle connector when mated thereto, and which discourages unqualified personnel from unlatching the connectors to unmate them. The plug connector has a pair of narrow release passages (64, 66, FIG. 3) for receiving small rods (60, 62) of a release tool, the plug connector having a thin breakable barrier (70, 72) near the top of each passage. Unqualified mechanics hesitate to break the barriers, and even when the barriers are broken there are only small passages for viewing the latching mechanism. A pair of pin contacts (20, 22, FIG. 14) of the receptacle connector, are connected together until the two connectors are mated, by the use of a wire conductor (210) that has a portion that is wound into a coil (212) that is forced over one pin contact, the coil having an arm (216) that presses against the other pin contact. A bent metal strip contact having one end (90, FIG. 9) forming a socket and the other end (134) crimping to a wire, has its opposite ends offset by rolling a middle portion (162) of the strip about an axis (153) that is angled about 45° from axes (151, 152) at the opposite ends of the contact.

6 Claims, 7 Drawing Sheets

70
100
72
82
120
106
104
16
26
138
134
90
132
140
102
136
54
92
80
42
86
116
84
114
135
44
112
130
94
110

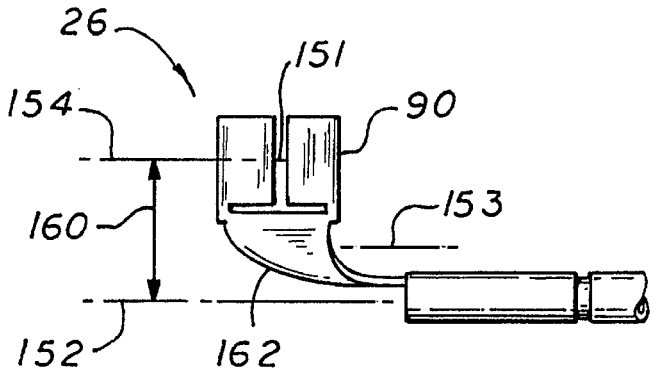
FIG. 8
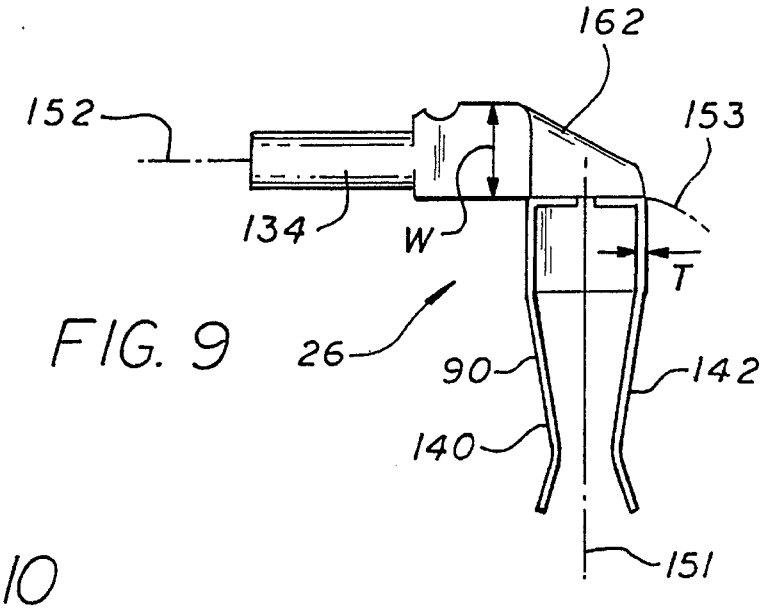
FIG. 9
FIG. 10
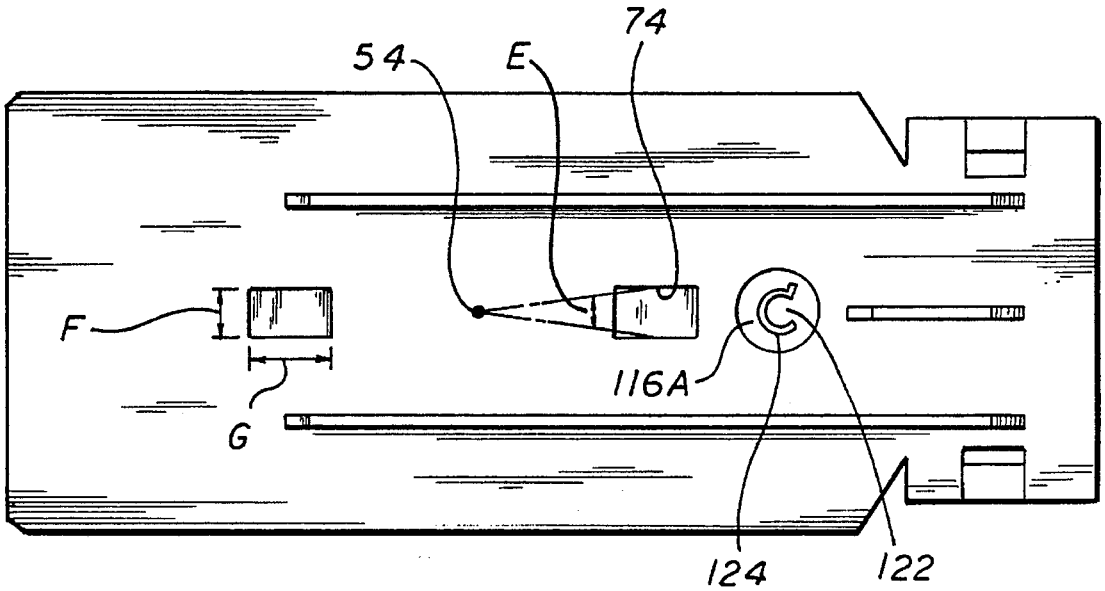

FIG. 14
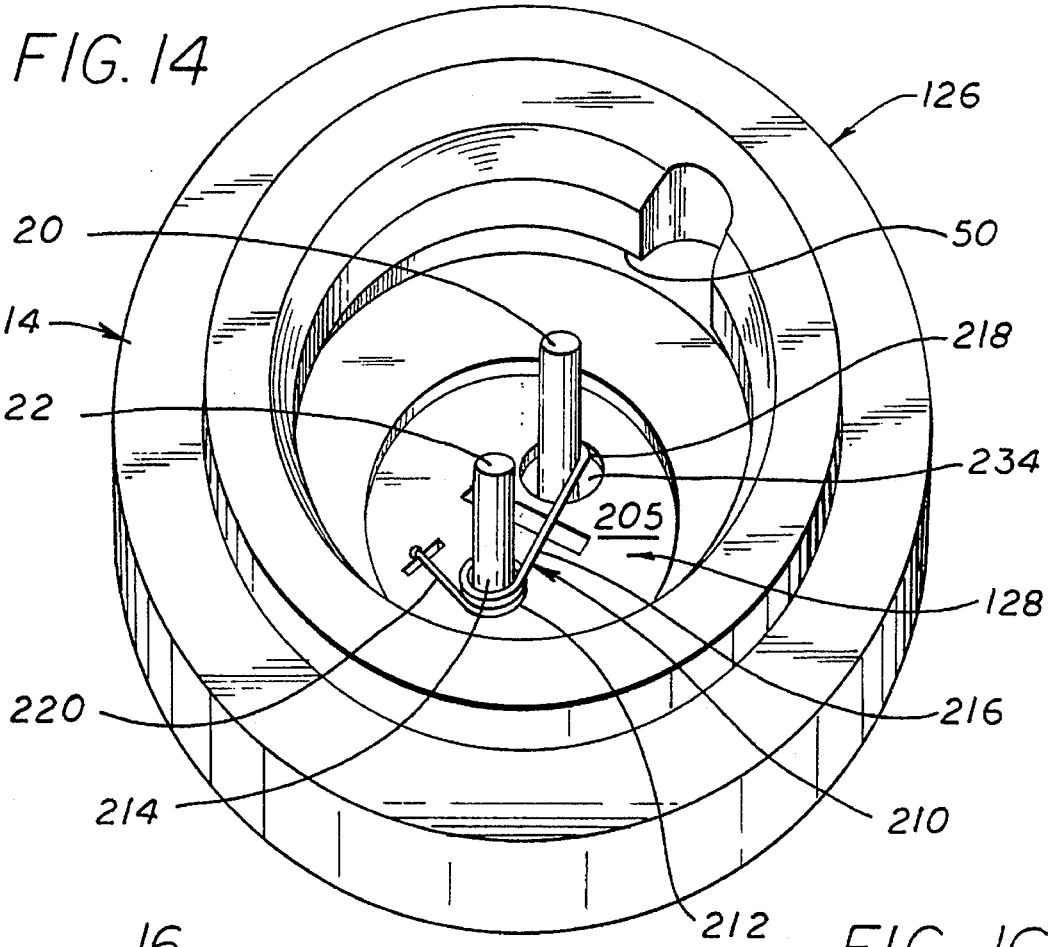
FIG. 16
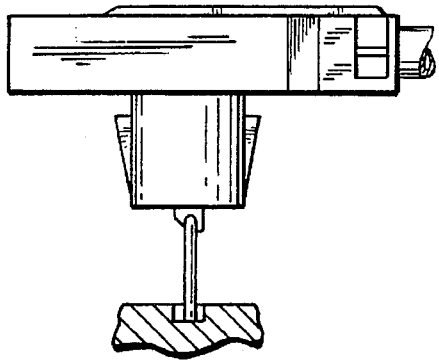
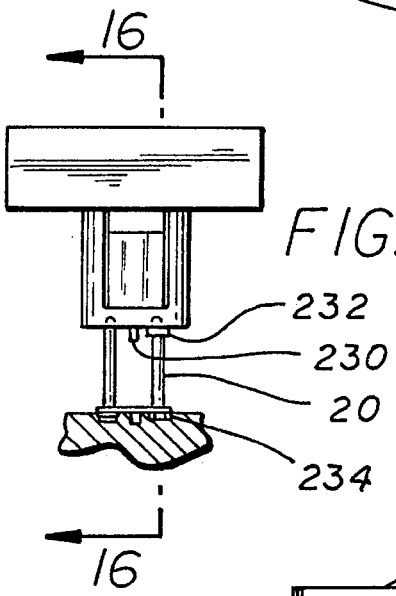
FIG. 15
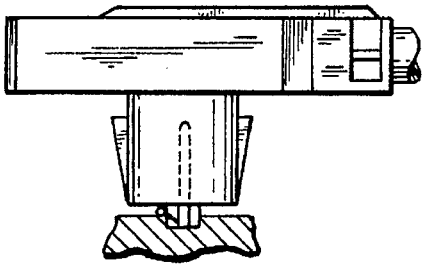
FIG. 17

SECURE CONNECTOR SYSTEM

BACKGROUND OF THE INVENTION

Automobile airbags are commonly inflated by currents passing from contacts of a plug connector to contacts of a receptacle connector that carry them to an ignitable squib. When the connectors are mated, it is very important that they not be unmated, except by qualified personnel. If an unqualified mechanic unmates the connectors and then fails to properly mate them, the airbag will be inoperative, but this fact is likely to be discovered only in a crash when the airbag is needed. It is desirable to provide a locking mechanism which can be operated by an experienced person with a special tool, but which discourages attempts by unskilled persons to operate it.

The pin contacts of the receptacle connector generally must be constantly shorted, or connected to each other, until they are mated to the contacts of the plug connector, when they must be unshorted. Such constant connection of the receptacle pin contacts, avoids the possibility that static electricity or a current generated by radio waves picked up by the contacts, will initiate the squib. It would be desirable if a simple shorting device could be used which could be easily and reliably mounted and which provided reliable shorting.

SUMMARY OF THE INVENTION

In accordance with one embodiment of the present invention, a connector system is provided which includes receptacle and plug connectors that can be mated, but whose unmating by unauthorized personnel is greatly discouraged. A connector such as the plug connector, has tool-receiving passages that receive a special unlatching tool. Thin breakable barriers lie near the top of the passages, with the need to break them discouraging unqualified personnel, and with a broken barrier indicating that the connector has been worked on. The latching mechanism can include deflectable members that can be disengaged from shoulders, with two narrow tool-receiving passages extending to the deflectable members. The narrow passages discourage a mechanic from trying to understand how the latching mechanism operates by viewing it through the narrow passages. The deflectable members can be formed on a clip that can be snapped onto one of the connectors.

The two receptacle pin contacts can be kept connected together, or shorted, by a spring wire that has a part wound in a coil and press fitted onto a first of the pin contacts. The coil has an arm that extends to the second contact, with the coil urging the arm to press continually against the second contact. A deflector on the plug connector deflects the arm out of engagement with the second contact.

The novel features of the invention are set forth with particularity in the appended claims. The invention will be best understood from the following description when read in conjunction with the accompanying drawings.

BRIEF DESCRIPTION OF THE DRAWINGS

FIG. 8 is a plan view of a contact of the plug connector of FIG.

FIG. 9 is a side elevation view of the plug connector of FIG. 8.

FIG. 10 is a plan view of the cover of the plug connector of FIG. 4, and showing a fully installed post.

FIG. 14 is an enlarged isometric view of a portion of the receptacle connector of FIG. 4.

FIG. 15 is an exploded sectional side view of the connector system of FIG. 1.

FIG. 16 is a view taken on line 16—16 of FIG. 15.

FIG. 17 is a view similar to that of FIG. 16, but with the connectors fully mated.

DESCRIPTION OF THE PREFERRED EMBODIMENTS

Figure 1:
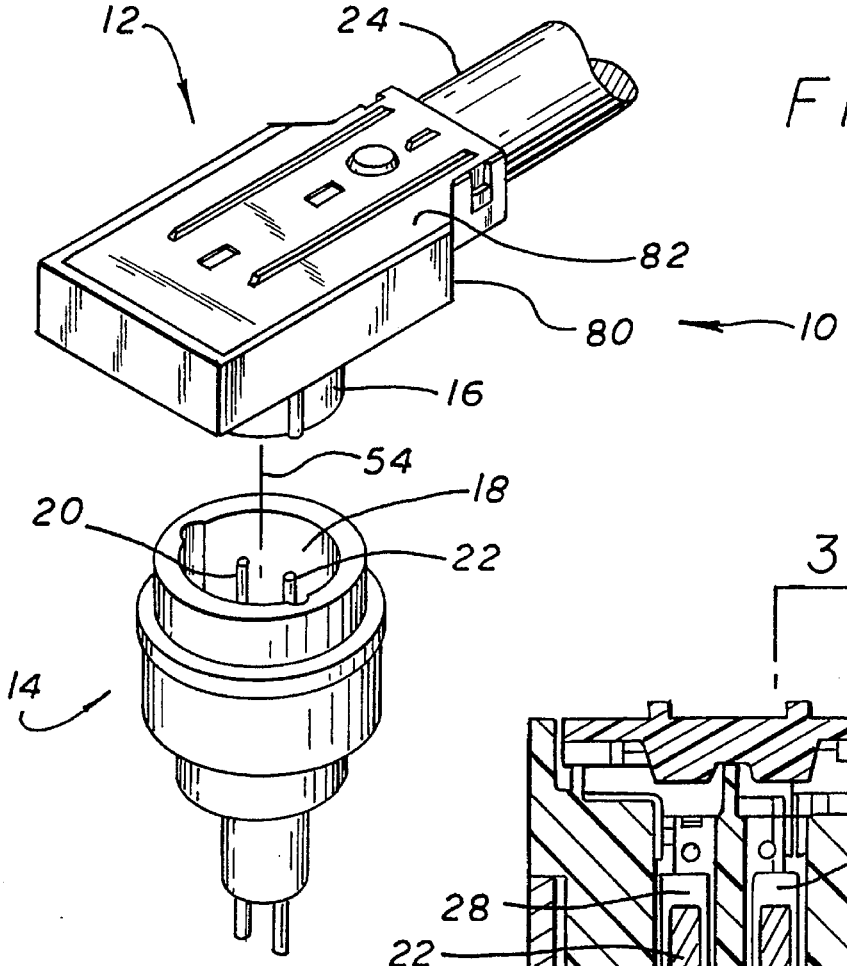
FIG. 1 is an exploded isometric view of a connector system constructed in accordance with one embodiment of the present invention.

FIG. 1 illustrates a connector 10 which includes a plug connector 12 that can mate with a base, or receptacle connector 14. The plug connector 12 has a plug part 16 that is received in a recess 18 of the receptacle connector. The particular connector system is designed for use in vehicles, with the receptacle connector 14 having contacts or terminals 20, 22 that are permanently connected to a squib that can inflate an airbag in an automobile, and with the plug connector 12 having contacts connected to wires of cable 24 that extends to a circuit with a current source.

Figure 2:
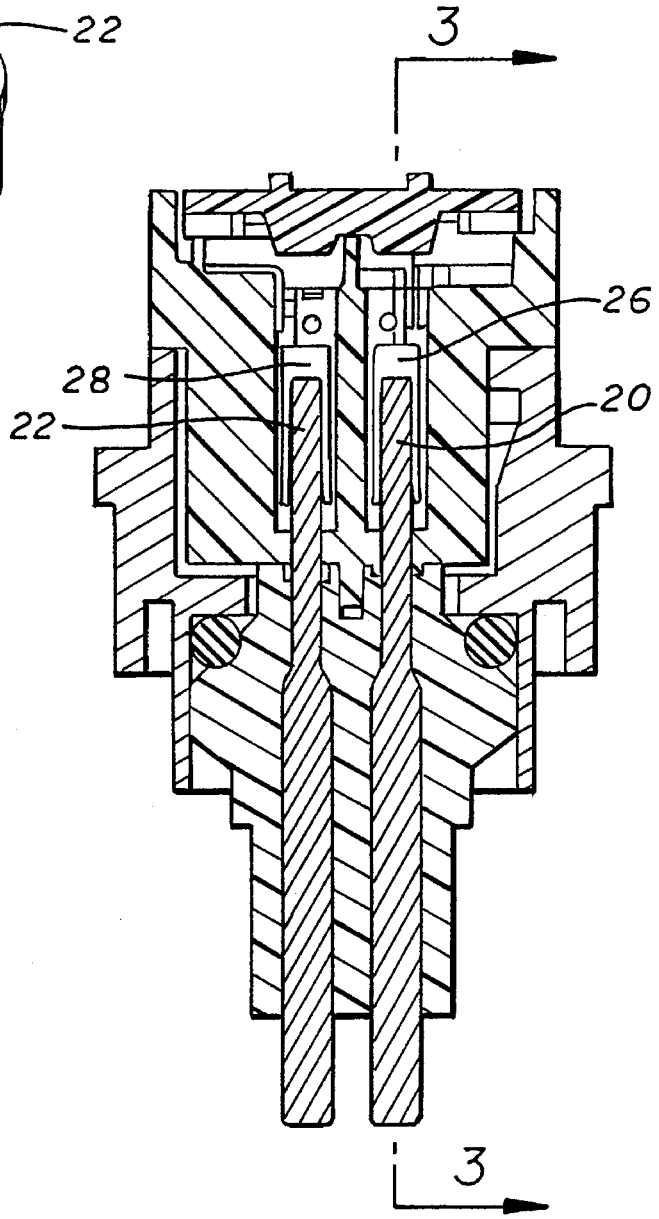
FIG. 2 is a sectional view of the connector system of FIG. 1, with the connectors fully mated.
Figure 3:
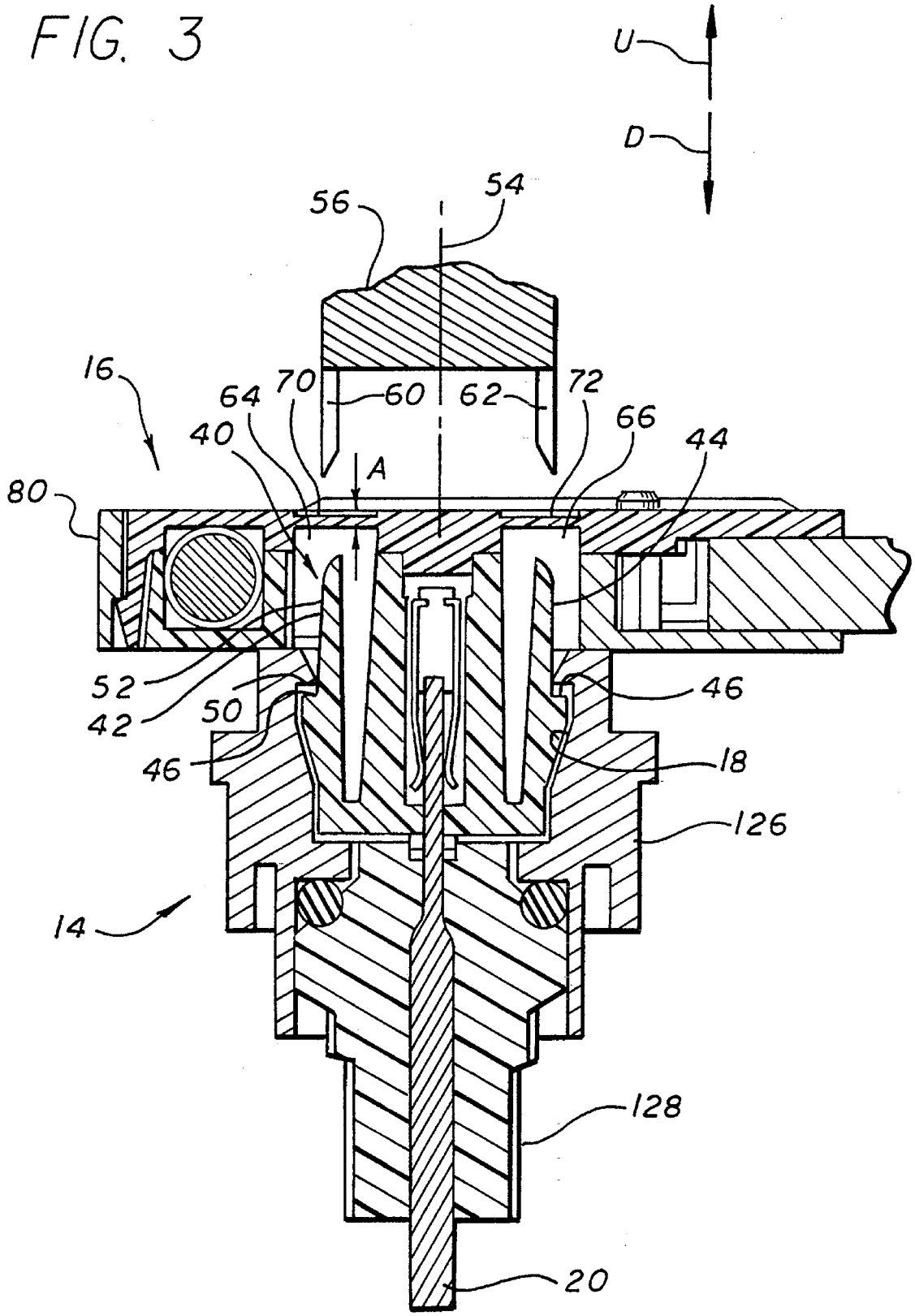
FIG. 3 is a sectional view taken on line 3—3 of FIG. 2.

FIGS. 2 and 3 show the connectors fully mated, with socket contacts 26, 28 of the plug connector mated with the pin contacts 20, 22 of the receptacle connector. As shown in FIG. 3, the connector system includes a lock or latch mechanism 40 for holding the mated connectors together. The mechanism includes a pair of deflectable members 42, 44 on the plug connector 16 that mate with parts of the receptacle connector 14. Each of the deflectable members 42, 44 has an upwardly-facing shoulder portion 46 that faces largely in an upward direction U. The receptacle connector forms a pair of downwardly-facing shoulder portions 50 that face generally in a downward direction D. When the connectors are fully mated, the shoulders 46, 50 lie adjacent to each other, and prevent unmating. The latching mechanism can be unlatched by deflecting upper portions 52 of the deflectable members closer to the vertical axis 54 of the connector system. This can be accomplished by a release tool 56 which carries a pair of release tool ends 60, 62. When the release tool is moved down, the release ends 60, 62 deflect the upper portions 52 of the deflectable members 42, 44 together so the shoulders 46, 50 are not in line (in a vertical direction), and the plug connector can be lifted up out of the recess in the receptacle connector.

Applicant greatly discourages unauthorized persons from unmating the connectors, by discouraging them from inserting tools into release passages 64, 66 that lead to the upper portions 52 of the deflectable members. One way that applicant discourages such projection of tools such as screwdrivers, is by providing barriers 70, 72 near the upper ends of the passages. The barriers 70 are of engineering plastic (Young's Modulus of Elasticity of at least 50,000 psi) and have a thickness A on the order of 0.25 mm, with the thickness being no more than about 0.5 mm, so the barriers can be readily broken by the tool ends 60, 62. However, the presence of barriers discourages untrained personnel from piercing them. Also, if the barriers are broken, this will be readily apparent, and a trained mechanic examining it will quickly realize this. To unmate the connectors, the release tool 56 is pushed into shallow recesses around the upper surfaces of the barriers to break the barriers and engage the deflectable members 42. With the tool in place, the plug connector is lifted off the receptacle connector.

FIG. 10 shows that the middles of the openings 74 that are covered by the barriers, each subtends an angle E of about 15° about the axis 54. The total angle 2E of the two openings which are circumferentially spaced about axis 54, is about 30°. Applicant prefers a total angle of no more than 60°, to limit viewing. In a connector applicant designed, each opening 74 has a width F of 1.5 mm and a length G of 2.2 mm, for an area of each of 3.3 $mm^2$. Such small area makes view of the latching mechanism difficult, and prevents exclusion of most screwdrivers available in auto shops.

Figure 7:
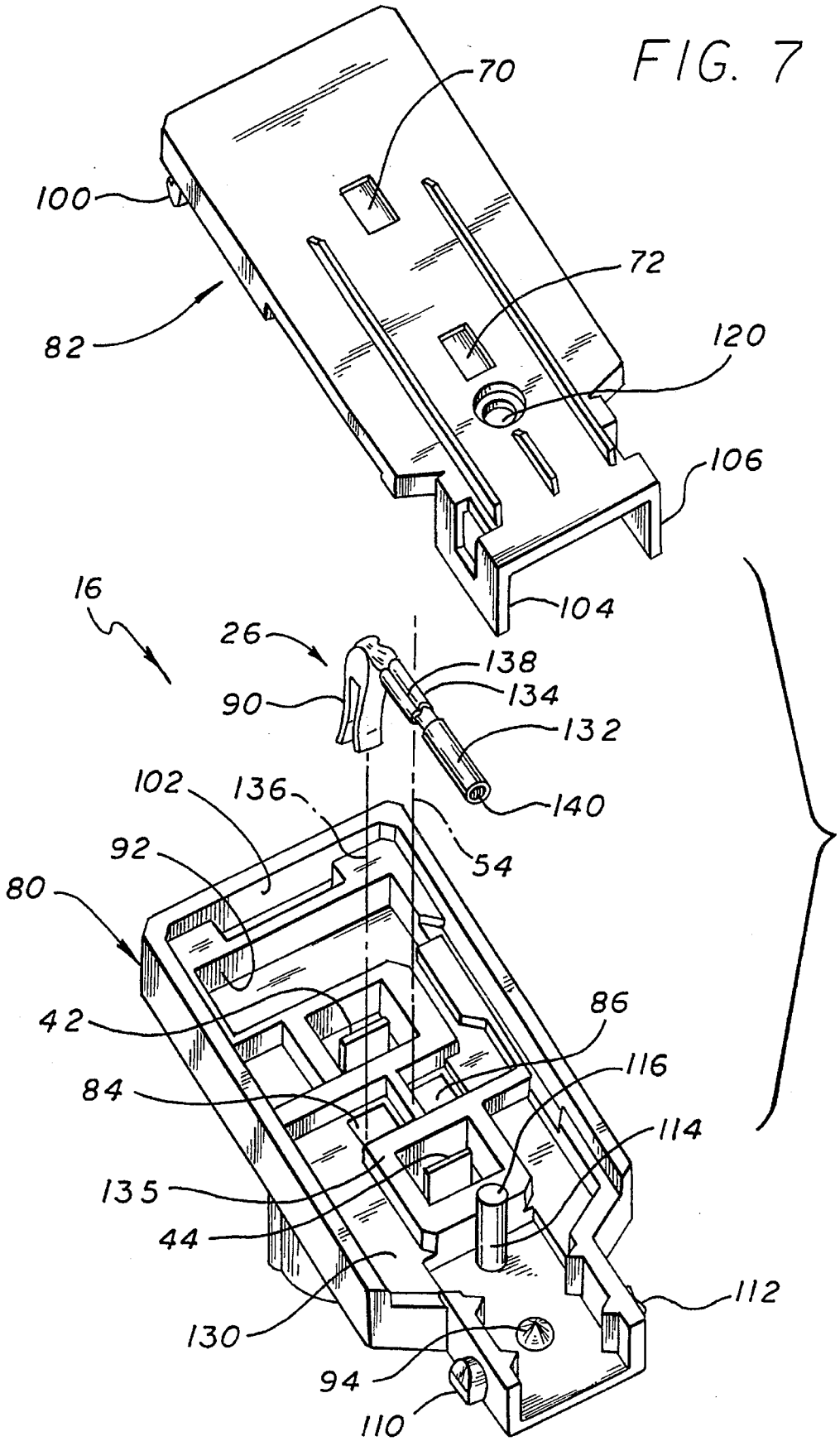
FIG. 7 is an exploded isometric view of the plug connector of FIG. 4.

As shown in FIG. 7, the plug connector 16 includes a housing 80 and a cover 82. The housing has a pair of contact passages 84, 86 that lie on opposite sides of the axis 54, with each passage constructed to receive the socket mating end 90 of the contact such as 26. The deflectable members 42, 44 are spaced apart in a perpendicular direction to lie on opposite sides of the axis 54. The housing has a cavity 92 that receives an inductor that connects to the contact that extends through the passage 86. The housing has a retention projection 94 that helps retain the cable. The cover 82 forms the barriers 70, 72.

The cover is initially fastened to the housing 80 by first inserting a hook 100 at one end of the cover into a slot 102 of the housing to hook under the walls of the slot, and by pivoting down the cover until a pair of cover arms 104, 106 snap over projections 110, 112 on the main housing part. To secure the cover to the housing, the housing is molded with an upstanding post 114 having an upper end 116 that projects through a hole 120 in the cover. Thereafter, a heated staking rod is applied to the post upper end 116 to downwardly deform it and enlarge its upper end, to lock the cover onto the main housing part. As shown in FIG. 10, the deformed post upper end 116A has a topmost surface 122 that bears a certification mark 124. The heat staking tool is formed with a recess (or possibly a projection) in a predetermined shape to form the certification mark 124. When a trained mechanic examines the connector system, he will be fairly certain that the cover has not been removed from the main housing portion and the connection system tampered with, by noting the certification mark.

The receptacle connector 14 (FIG. 3) includes a metal upper housing part 126 (often referred to as the initiator base) and a dielectric lower housing part 128 (often referred to as the initiator) that holds the contacts 20, 22.

Referring again to FIG. 7, it can be seen that the housing 80 has a cable wire guiding channel 130 which guides a wire 132 extending from the tail end 134 of the contact 26, around a barrier wall 135 that isolates a cavity that holds the deflectable member 44. Although the socket mating end 90 of the contact 26 must extend along vertical line 136 into the passage 84, the contact tail end 134 that forms a crimp 138 to attach to the conductor 140 of the wire, must extend along the offset channel 130. If a simple round wire were used, such offset could be achieved by two 90° bends. However, the contact 26 is formed of sheet metal that can be readily bent in one direction but not a perpendicular direction. That is, sheet metal cannot be readily bent about an axis extending normal to the surfaces of the sheet metal. Applicant's construction of the contact 26 facilitates such an offset with a contact formed of a strip of sheet metal.

FIGS. 8 and 9 show the construction of the contact 26. The socket mating end 90 of the contact includes two largely vertical sheet metal portions 140, 142 that extend along a first axis 151 that extends vertically. The tail end 134 forms a tube that extends along a second axis 152 that extends horizontally. The first and second axes 151, 152 are orthogonal, except that they are horizontally offset by a distance 160. That is, the first axis 151 is orthogonal to, and intersects a fourth axis 154 that extends parallel to the second axis 152. A middle portion 162 of the sheet metal of the contact, is rolled, or bent at a large radius of curvature (e.g. 0.8 mm) that is a plurality of times greater than the thickness T (e.g. 0.2 mm) of the sheet metal, about a third axis 153. The third axis 153 lies between the first and second axes 151, 152 and is angled by a plurality of degrees more than zero and a plurality of degrees less than 90° from being parallel to either of the axes 151, 152, the axis 153 preferably extending at an angle of about 30 to 60 degrees from both axes 151, 152. Such rolling of the sheet metal middle portion 162, results in the offset 160, which allows the socket mating end 90 of FIG. 7 to extend through the first passage 84, while allowing the wire 132 to extend along the offset channel 130. The contact has a cutout 162 at one end of the curved middle portion to aid in the curving, or bending.

Figure 11:
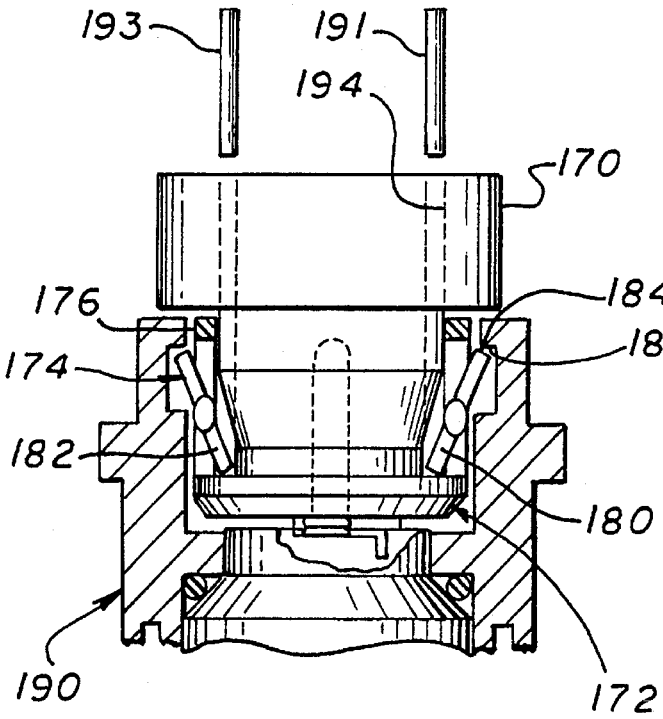
FIG. 11 is a partial sectional view of a connector system of another embodiment of the invention, which is modified from that shown in FIG. 3.
Figure 12:
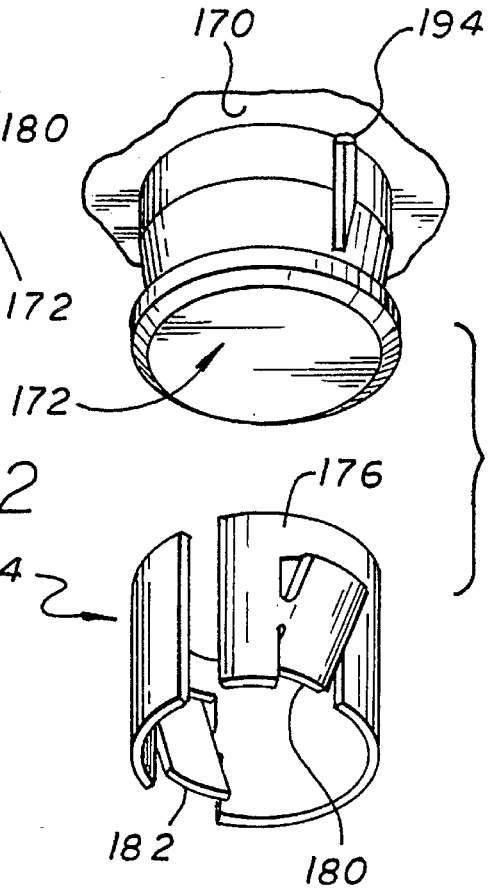
FIG. 12 is a partial isometric view of the plug connector of FIG. 11.

In FIG. 3, the deflectable members 42, 44 are integrally molded with the rest of the main housing part 80 of the plug connector. It is possible to simplify the molding of the main housing part 80 and minimize breakage of the deflectable members, by forming the deflectable members 42, 44 on a separate clip. FIGS. 11 and 12 show a portion of a plug connector 170 which has a downwardly-extending plug part 172 that holds a clip 174. The clip (which can be considered as part of the plug connector) can be formed of sheet metal (or molded separately of plastic), and has a cylindrical portion 176 that closely surrounds a part of the plug part 172. The clip is formed (e.g. bent or molded) with a pair of tabs 180, 182 that are bent, so as shown in FIG. 11 each tab forms a largely upwardly-facing shoulder 184 that engages a largely downwardly-facing shoulder 186 on the receptacle 190. Tool ends 191,193 can be projected through passages 194 to deflect the tabs so the shoulders 184, 186 are out of line and the plug part can be lifted up out of the receptacle.

Figure 13:
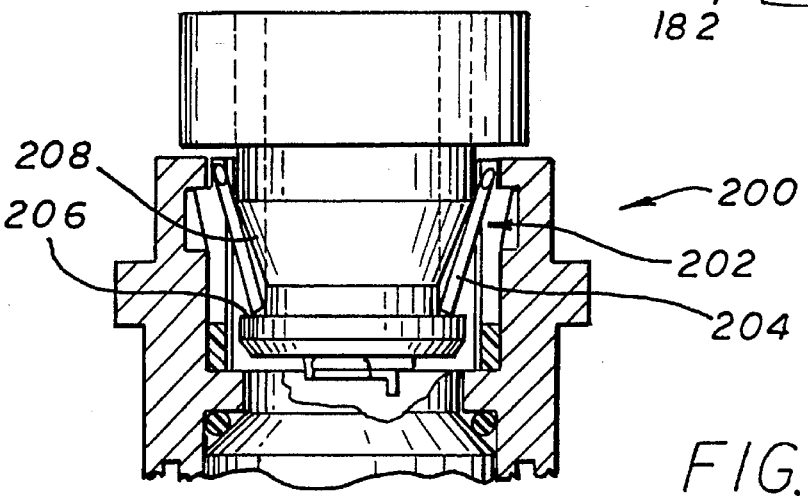
FIG. 13 is a partial sectional view of a connector system constructed in accordance with still another embodiment of the invention.

FIG. 13 illustrates another connector system 200, where the clip 202 has tabs 204 that can be deflected out of engagement with upwardly-facing shoulder portions 206 formed on the plug part 208.

As shown in FIG. 14, the terminals or contacts 20, 22 of the receptacle project above an upper surface 205 of the receptacle connector. The contacts 20, 22 must be electrically connected together, or shorted, prior to connector mating. Applicant prefers to accomplish this by the use of a conductive spring wire 210. The wire has a portion in the form of a coil 212 with more than a 360° turn, and preferably with a plurality of complete turns, which surrounds one of the contacts 22. The coil 212 is initially wound to have a smaller inside diameter than the outside diameter of the lower exposed portion 214 of the contact 22. As a result, the coil 212 is installed in an interference fit with the contact portion 214, which assures that the wire will be mechanically securely mounted, and so that the wire will be electrically connected to the contact 22. The wire has an arm 216 which extends between the contacts 20, 22, and which presses against a side of the contact 20, under the force of the coil 212. The coil assures firm contact of the arm end 218 with the contact 20, while permitting considerable deflection of the arm 216 away from the contact 20. It is noted that the coil has another arm 220 that is held in position on the receptacle connector (or initiator).

Figure 5:
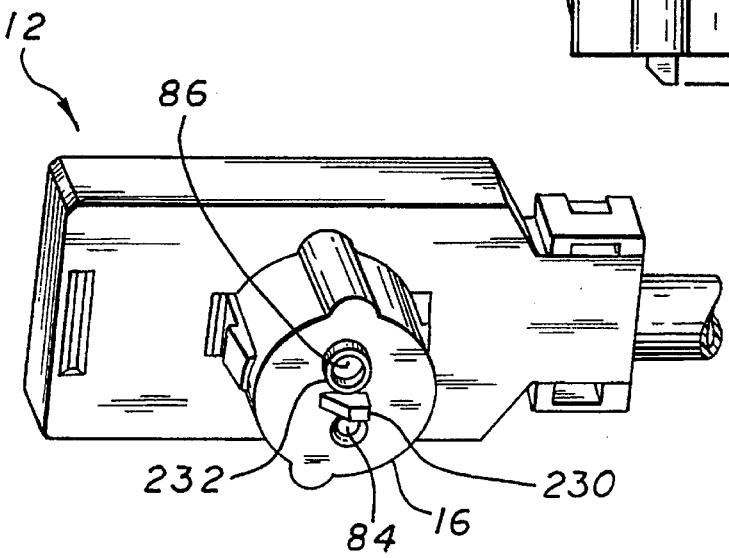
FIG. 5 is an isometric view of the plug connector of FIG. 4.

FIG. 5 shows that the plug part 16 has a spring deflector 230 lying between the passages 84, 86 that hold the plug socket contacts. As shown in FIG. 16, as the connectors mate the spring deflector 230 deflects the arm 216 out of engagement with the contact 20. Applicant provides a projection in the form of a chimney 232 (FIG. 15) about one of the passages 86, which is received in a recess 234 lying around the bottom of the receptacle contact 20. When the connectors are fully mated, the chimney 232 lies in the recess 234, and provides added assurance that the spring arm end 218 will not engage the contact 20.

Figure 4:
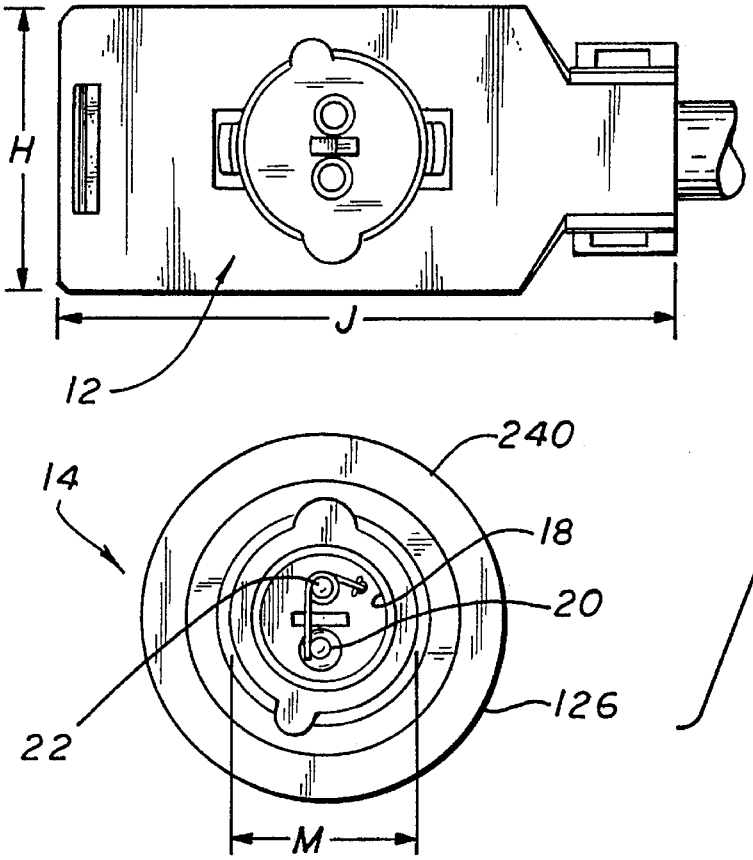
FIG. 4 is an exploded plan view of the connector system of FIG. 1, showing the bottom of the plug connector and the top of the receptacle connector.
Figure 6:
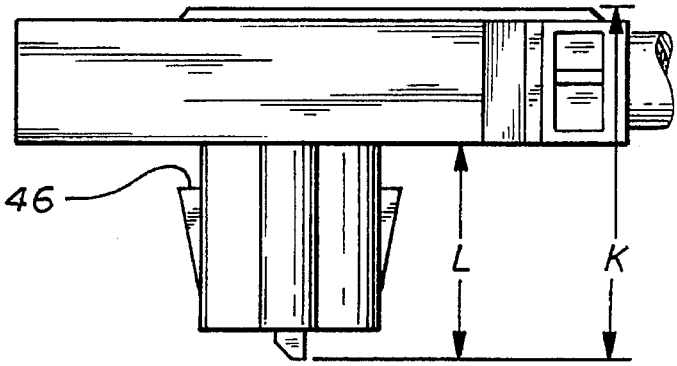
FIG. 6 is a side elevation view of the plug connector of FIG. 4.

In a connector system that applicant has designed and built, the plug connector 12 (FIG. 4) has a width H of 14 mm, a length J of 30 mm, and a height K (FIG. 6) of 14.8 mm, with the plug part having a height L of 8.5 mm. The receptacle has a metal upper housing part 126 (FIG. 4) that forms the recess 18 with a smallest diameter M of 9.6 mm. Each contact 20, 22 has a width of about 1.1 mm.

Although terms such as "up" and "down" have been used to describe the connector system as illustrated, the connector system can be used in any orientation with respect to Earth's gravity.

Thus, the invention provides a connector system comprising plug and receptacle connectors, which strongly resists unmating of the connectors by untrained personnel. This is accomplished by providing a latching mechanism that is accessible from the top of the plug, only through narrow passages, and with the upper portions of the passages being blocked by breakable barriers. The invention also provides an improved shorting spring to keep the receptacle contacts or terminals shorted until the plug and receptacle are mated. The shorting spring is formed by a length of spring wire which has a coil portion lying in interference fit with one of the receptacle pin contacts, the coil having an arm that presses against a side of the other receptacle terminal. The plug portion has a deflector that deflects the arm out of engagement with the second receptacle contact. Opposite ends of a contact formed of a strip of sheet metal extend in largely perpendicular directions, and are offset from each other by forming a middle portion of the strip in a roll, that is a large radius bend bent about an axis extending about 45° to each of the perpendicular axes at the opposite ends of the contact. The plug connector includes a main housing portion and a cover that are fixed together by a heat stake post, with the end of the post having a certification mark.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An electrical connector system which includes a receptacle connector having a recess and a plurality of electrical first contacts, and a plug connector which has a plug part that fits into said recess and which has a plurality of electrical second contacts that are mateable to said first contacts, said plug connector having a releasable latch mechanism which locks to said receptacle connector when they are engaged together, with one of said connectors having at least one release passage for receiving a release tool to release said latch mechanism so said connectors can be separated from each other, characterized by:

said one of said connectors has an outer wall of largely rigid engineering plastic that includes a thin section forming a breakable barrier lying along said at least one passage, which blocks movement of the release tool along said passage until said barrier is broken but which breaks when said release tool is inserted into said at least one passage, to thereby discourage tool insertion by an unskilled person.

2. The electrical connector system described in claim 1 wherein:

said breakable barrier is integral with the rest of said outer wall, with said barrier having a thickness on the order of magnitude of one-quarter millimeter, and said barrier having a width and length that are each a plurality of times greater than said thickness.

3. The electric connector system described in claim 1 wherein:

said connectors lie on an axis which extends along the direction of movement of said plug part into said recess;

said releasable latch mechanism includes a pair of downwardly-facing shoulder portions formed on said receptacle connector at locations spaced about said recess, a pair upwardly-facing shoulder portions formed on said plug connector, and a pair of radially deflectable members on a first of said connectors which engages shoulders on the second of said connectors, with said deflectable members being radially deflectable with respect to said axis to move said deflectable members out of engagement with said shoulders on said second connector so said plug part can be withdrawn from said recess, with said at least one passage being aligned with said recess of said receptacle so said deflectable members can be deflected by a tool projecting into said recess.

4. An electrical connector system which includes a receptacle connector having a recess and a plurality of electrical first contacts, and a plug connector which has a plug part that can move down along a vertical axis into said recess and which has a plurality of electrical second contacts that are mateable to said first contacts, said plug connector forming a releasable latch mechanism which locks to said receptacle connector when they are engaged together, characterized by:

said plug connector forms a pair of largely upwardly-facing shoulder portions spaced about said axis while said receptacle connector forms a pair of largely downwardly-facing shoulder portions spaced about said axis, and said plug connector has a pair of radially deflectable members that engage the shoulder portions of said receptacle connector but that can be deflected out of such engagement to permit said plug part to be withdrawn from said recess;

a selected one of said connector has a top wall with a pair of tool-passing areas circumferentially spaced about said axis and said selected one of said connectors has a pair of vertical passages which extend downwardly from said tool-passing areas and that are aligned with said deflectable members to pass tool parts that can deflect said deflectable member;

said top wall has thin breakable portions each lying at one of said tool-passing areas, with the thickness of each of said thin breakable wall portion being less than that of a surrounding area of said wall, to thereby discourage tool insertion by an unskilled person.

5. The electrical connector system described in claim 4 wherein:

said top wall has an upper surface and said pair of tool-passing areas each form a depression in said upper surface, with said depressions each subtending an angle of no more than 30° about said axis, and each having a width of no more than 4 mm, so when said areas are open, it is difficult to see through them to determine how to unlatch said mechanism.

6. The electrical connector system described in claim 4 wherein said thickness being no greater than about 0.5 mm.

* * * * *